US006045081A

United States Patent [19]

Oberstrass et al.

[11] Patent Number: 6,045,081

[45] **Date of Patent: *Apr. 4, 2000**

[54] METHOD AND APPARATUS FOR WINDING A CONTINUOUSLY ADVANCING YARN

[75] Inventors: Detlev Oberstrass, Velbert; Reinhard Lieber, Sprockhovel, both of Germany

[73] Assignee: Barmag AG, Remscheid, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/191,503

[22] Filed: Nov. 13, 1998

[30] Foreign Application Priority Data

Nov. 14, 1997 [DE] Germany ..... 197 50 510

[51] Int. Cl.[7] ..... B65H 67/04

[52] U.S. Cl. ..... 242/473.8; 242/476.4; 242/481.4

[58] Field of Search ..... 242/125.1, 473.7, 242/473.8, 474.7, 476.4, 476.5, 488, 481.4

[56] References Cited

U.S. PATENT DOCUMENTS

| | | | |
|---|---|---|---|
| 3,899,140 | 8/1975 | Gleyze | 242/476.4 |
| 4,340,187 | 7/1982 | Schippers et al. | 242/473.7 |
| 4,948,057 | 8/1990 | Greis . | |
| 5,005,776 | 4/1991 | Schwarz | 242/488 X |
| 5,465,916 | 11/1995 | Konig | 242/125.1 X |
| 5,549,254 | 8/1996 | Menegatto | 242/125.1 X |
| 5,639,037 | 6/1997 | Marangone et al. | 242/477.7 |
| 5,918,829 | 7/1999 | Fah | 242/481.4 |

FOREIGN PATENT DOCUMENTS

| | | |
|---|---|---|
| 0 311 827 | 4/1989 | European Pat. Off. . |
| 43 34 813 | 5/1994 | Germany . |

*Primary Examiner*—Michael R. Mansen
*Attorney, Agent, or Firm*—Alston & Bird LLP

[57] ABSTRACT

A method and apparatus for winding a continuously advancing yarn at a constant winding speed to form a cross-wound package on a driven tube. During thread-up of the yarn onto the tube, the yarn is caught outside of the winding range in a catching device rotating at the rotational speed of the tube, and initial layers of the yarn are then wound on the tube. The yarn is guided by a movable yarn guide, which is connected to a drive, and the movement of the yarn guide is controlled as a function of the rotational speed of the tube such that upon reaching the winding speed the yarn is caught and the initial layers thereof are wound. To this end, the rotational speed of the tube is sensed by means of a sensor and supplied to a controller that controls the drive of the yarn guide.

21 Claims, 4 Drawing Sheets

METHOD AND APPARATUS FOR WINDING A CONTINUOUSLY ADVANCING YARN

BACKGROUND OF THE INVENTION

The present invention relates to a method and apparatus for winding a continuously advancing yarn to form a cross wound yarn package, and more particularly, to a method and apparatus for threading an advancing yarn onto a rotating bobbin tube at the beginning of the winding operation.

DE 43 34 813 discloses a yarn winding apparatus, wherein an advancing yarn is wound on a driven tube. In this apparatus, the tube is clamped between two centering plates, which are mounted for rotation on a package holder. The bobbin tube lies against a drive roll and is driven thereby. After the tube has reached a predetermined winding speed, the yarn is caught and cut in the circumferential region of a centering plate, with the loose yarn end being received in a suction device. After winding some initial layers on the tube on the end next to the winding range so as to form a so-called yarn reserve wind, the winding of the package starts. To catch and initially wind the yarn, the yarn is guided by a movable auxiliary yarn guide before being released for the actual winding cycle.

Such winding apparatus are used, for example, in texturing machines for winding a textured yarn to a package. In this process, the continuously advancing yarn is received by a suction device before catching and winding the yarn in the initial layers on the empty tube. The yarn removed by suction is delivered to a waste receptacle. It is therefore attempted to keep the time as short as possible, during which the yarn is guided by the suction device, i.e., during each package doff.

EP 0 311 827 discloses a method and an apparatus, wherein the yarn is guided during a package doff by a traversing yarn guide that is driven by a stepping motor. This method eliminates a transfer of the yarn to the yarn traversing device after catching and winding the initial layers. However, this method and apparatus have likewise the disadvantage that the package doffing phase during which waste yarn is produced requires a relatively great deal of time.

It is accordingly an object of the present invention to further develop a method and apparatus of the above described type such as to minimize the amount of waste of the continuously advancing yarn before catching same and winding initial layers thereof on the bobbin tube. A further object of the invention is to catch the yarn with great reliability before winding.

SUMMARY OF THE INVENTION

The above and other objects and advantages of the present invention are achieved by the provision of a winding method and apparatus wherein the yarn is caught by means of a catching device and wound on the tube without time delay directly after reaching the rotational speed necessary for the winding. To this end, the rotational speed of the tube is continuously monitored, and as soon as the predetermined winding speed is reached, the drive of a yarn guide is activated so as to move the yarn guide into a yarn catching position, and thereby causing the yarn to be caught and wound into initial layers on the tube. The winding speed corresponds to the rotational speed of tube, which generates a circumferential surface speed on the tube that is substantially the same as the yarn speed.

The invention also offers the possibility of advancing the sequence of movements of the yarn guide to the acceleration phase of the tube. This is especially advantageous in cases in which the yarn is initially caught on a larger diameter than the tube diameter. To maintain a substantially constant winding speed of the yarn, it is therefore necessary to drive during the catching the catching device that rotates at the speed of the tube, at a lower speed than the winding speed.

A particularly advantageous embodiment of the method provides that the position of a catching groove in the catching device is detected by means of a sensor which generates a signal for initiating the movement of the yarn guide. This has the advantage that the yarn is caught by the catching device without substantial delay immediately upon reaching a catching position of the yarn guide. Since the yarn continues to be guided in the suction device until it is caught, this embodiment leads to a further reduction of the amount of yarn going to waste.

The movement of the yarn guide may be controlled in either direction by a controllable drive at a variable speed. This renders it possible to wind the yarn reserve as a function of the winding speed of the tube, when winding the initial yarn layers on the tube. This also allows the number of winds on the tube surface as well as the length of the yarn reserve wind on the tube surface to be adapted to the respective winding speed. Furthermore, this variant of the method has the advantage of facilitating the transfer of the yarn from the yarn guide to a yarn guide of the traversing device where separate yarn guides are employed.

A particularly advantageous further development of the method is characterized in that the yarn is guided in a controllable manner in each phase during the catching, initial winding, and winding. During the winding of the yarn, the rotational speed signal of the tube may be used to control the traversing speed of the yarn guide.

Furthermore, the method may be expanded such that after winding the yarn, the yarn guide is moved to a transfer position within the winding range for forming a tie-off wind. After winding the tie-off wind on the full package, the yarn is guided by a transfer device to a suction device for being cut and removed. Thus, the yarn end is conspicuously deposited on the full package.

Upon the completion of the winding operation, the full yarn package is moved out of the winding position, and for transferring the advancing yarn to an empty bobbin tube which is moved into the winding position, the yarn is supplied to a suction device by a pivotable transfer device which moves between the full package and the empty tube. This results in a particularly protective transfer of the yarn to the suction device, since the yarn is not subjected to substantial deflections which lead to substantial changes in the yarn tension.

The suction device which then receives the advancing yarn may be used in association with the yarn guide to transfer the yarn to the empty tube in the manner described above, to thereby continuously wind the advancing yarn.

The apparatus of the present invention is provided with a sensor, which senses the rotational speed of the tube and supplies the signal of the speed to a controller, which controls the drive of the yarn guide. Thus, it is ensured that the movement of the yarn guide is performed by the drive only after reaching a predetermined winding speed.

The same or a different sensor may sense the position of the catching groove of the catching device, which is especially suited to increase the catching reliability during the catching of the yarn.

Furthermore, the time during which the yarn is extremely deflected for presenting the yarn to the catching device for catching, is considerably shortened.

In one specific winding apparatus of the present invention, the tube is clamped between two centering plates mounted on a package holder, and the catching device is formed on one of the centering plates. This renders it possible to sense in a simple manner the rotational speed of the tube and the position of the catching groove in the catching device, with a common sensor.

In this connection, it will be especially advantageous, when the sensor is in the form of a pulse generator. This allows both the position and the rotational speed of the tube to be determined from the pulse sequence.

The yarn guide may be formed by a traversing yarn guide of the traversing device, which is able to guide the yarn outside and inside the winding range on the bobbin tube. Thus the traversing yarn guide can be driven bi-directionally by a drive that is variable in its speed. This embodiment has the advantage that no additional control unit is required for controlling the yarn traversing device. All operations during the winding as well as during the package doff are controlled via one controller.

After the yarn is caught and initial layers thereof are wound on the tube, the actual winding cycle starts, i.e., the winding of the package. After the package is fully wound, the yarn is taken over by the suction device for purposes of initiating the package doff. The configuration of the winding apparatus in accordance with the invention has in this instance the advantage that a tie-off wind is wound on the full package. To this end, the suction device and the traversing yarn guide are positioned in one plane, so that the yarn end is reliably deposited on the tie-off wind.

The sensor may be arranged on the package holder. This provides the special advantage that the package doff, i.e., the replacement of the full package with an empty tube occurs immediately after stopping the package holder. To this end, the signal generated by the sensor is used to activate a doffing device.

BRIEF DESCRIPTION OF THE DRAWINGS

In the following, the method as well as the apparatus of the present invention are described in more detail, with reference to the attached drawings, in which.

DETAILED DESCRIPTION OF THE PREFERRED EMBODIMENTS

Figure 1:
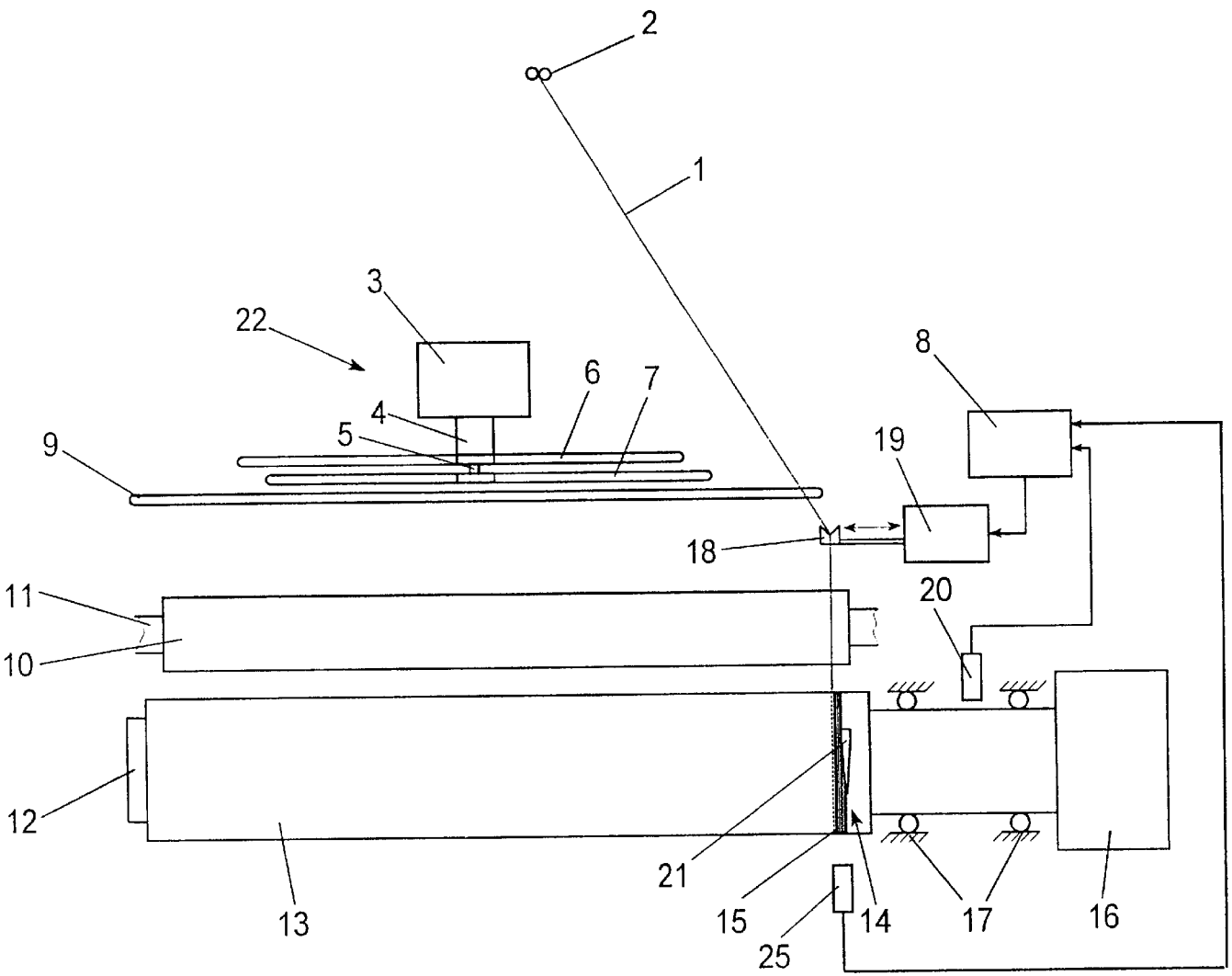
FIG. 1 is a schematic view of a yarn winding apparatus according to the invention and wherein the bobbin tube is mounted on a driven winding spindle.

FIG. 1 shows a first embodiment of the winding apparatus for winding an advancing yarn 1 in accordance with the invention. The apparatus comprises a winding spindle 12, which is mounted in cantilever fashion by means of bearings 17 to a machine frame. At the bearing end, the winding spindle 12 is connected to a spindle drive motor 16. The winding spindle 12 coaxially mounts a bobbin tube 13. A contact roll 10 extends with its axis parallel to winding spindle 12 at a distance from tube 13. The contact roll 10 with its shaft 11 is supported for rotation in the machine frame. Upstream of winding spindle 12 and contact roll 10, a yarn traversing device 22 is arranged on the machine frame. In the embodiment illustrated in FIG. 1, the yarn traversing device 22 is of the rotary blade type, which will be described below with regard to its construction and function.

Arranged between the traversing mechanism 22 and contact roll 10 is a guide bar 9.

The bobbin tube 13 mounted on winding spindle 12 possesses at its one end a catching device 14. At the end of tube 13 with catching device 14, a movable yarn guide 18 is arranged above the winding spindle. The yarn guide 18 is connected to a drive 19, which moves the yarn guide 18 in a parallel plane to winding spindle 12 in the axial direction of tube 13 away from the tube end and back to the tube end. The drive 19 is connected to a controller 8. In the region of the winding spindle 12, a sensor 20 is provided for detecting the rotational speed of the winding spindle. The sensor 20 is connected to the controller 8. In the region of the catching device 14, a further sensor 25 is provided, which detects the position of a catching groove 21 in catching device 14. The sensor 25 is likewise connected to the controller 8.

FIG. 1 shows the situation during operation, in which the yarn 1 advancing continuously via yarn guide 2 arrives at the winding position and contacts tube 13 while being guided by yarn guide 18. The yarn 1 having previously engaged catching device 14 is initially wound on tube 13 to a yarn reserve wind 15. Before catching the yarn in catching device 14, the loose yarn end is guided by means of a hand-held suction device and the yarn guide 18. In this process, the yarn guide 18 may be in a position inside the winding range or outside the winding range. After the controller 8 has found from the signal received from sensor 20 as well as from the signal received from sensor 25 that the necessary winding speed of tube 13 is reached, and that the yarn guide is just in a position which facilitates a reliable catching, the drive 19 is activated. With that, the yarn guide 18 starts to move, and it guides the yarn 1 into alignment with the catching device 14. After the yarn 1 is engaged by the tube, the yarn guide 18 keeps the yarn ready for winding the initial layers on the tube. After the yarn reserve wind is wound on the tube, the yarn 1 is released from yarn guide 18 and taken over by the yarn traversing device 22. To this end, the yarn guide may be constructed, for example, for a pivotal movement in the axial direction.

The yarn traversing device 22 is of the so-called rotary blade design. A traversing yarn guide 7 is in the form of a rotary blade and is rotated by means of a rotor 5 such that the yarn 1 is guided from the right edge to the left edge of the package. In this process, the yarn slides along a guide bar 9, so that the position of the yarn on the traversing yarn guide does not change significantly. After the yarn 1 has been guided to the left package edge, the traversing yarn guide 7 moves below the guide bar 9. As a result, the yarn 1 is released and received at the same time by oppositely rotating traversing guide 6 which emerges at the guide bar 9, and it is guided by means of traversing yarn guide 6 to the right end of the winding range. To this end, the traversing yarn guide 6 is driven by a rotor 4 in an opposite direction of rotation. At the right end of the package, the yarn transfer is repeated, in that the traversing yarn guide 6 moves below guide bar 9, and the traversing yarn guide 7 takes over the yarn.

During the winding time, the contact roll 10 rests with a force against the circumference of the package. With the aid of the contact roll, the drive 16 of winding spindle 12 is controlled in such a manner that the winding speed remains substantially constant during the winding time.

After the package is fully wound, the winding spindle is rotated with the full package out of the operating position. A second driven winding spindle (not shown) with an empty tube is then rotated into the operating position. At this time, a doffing device starts to operate, which guides the yarn out of the traversing device and keeps same ready together with yarn guide 18 for catching on the new tube.

A winding apparatus as described above is used, for example, for winding freshly spun synthetic filament yarns.

Figure 2:
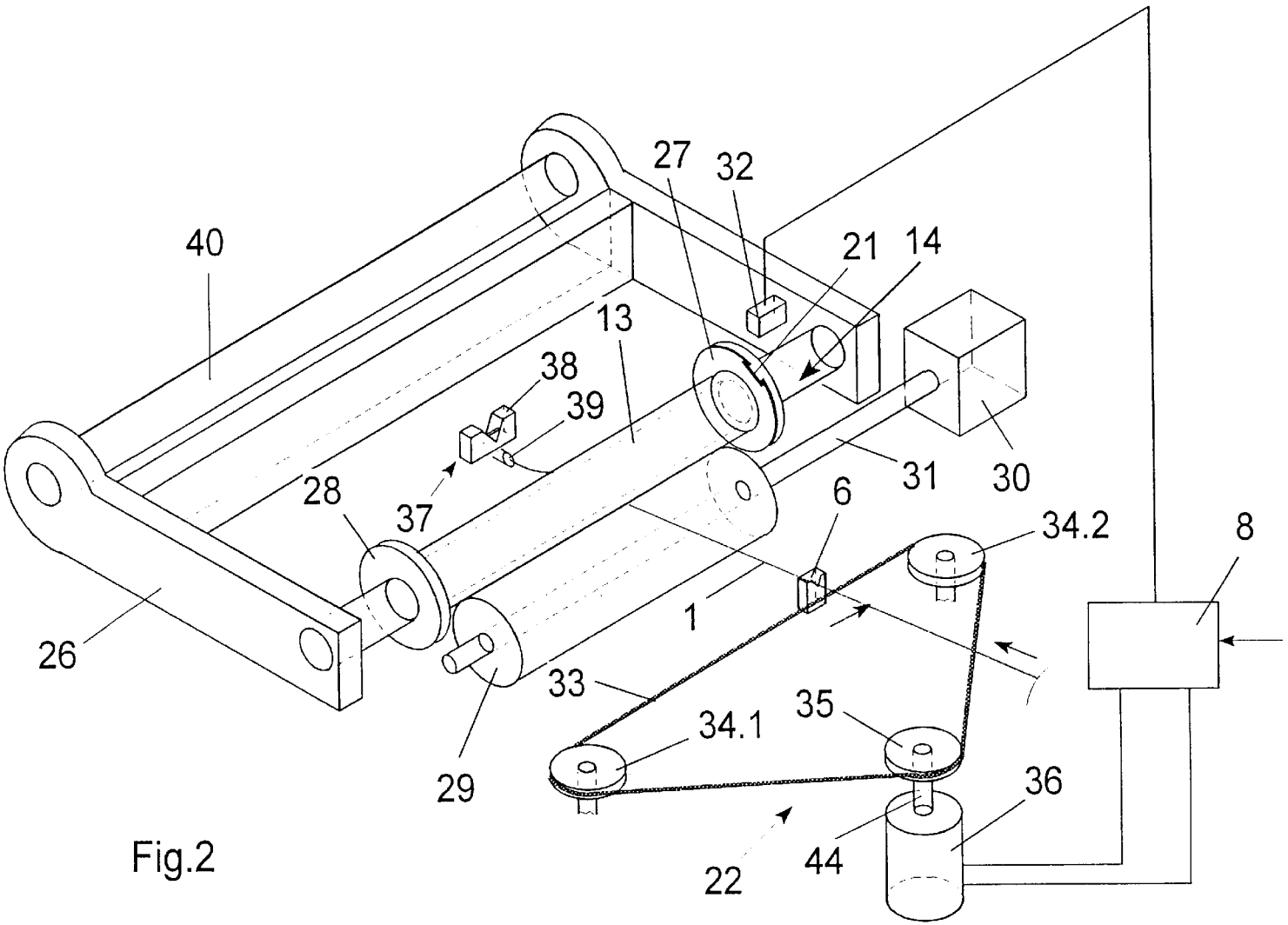
FIG. 2 illustrates a winding apparatus according to the invention with a drive roll drive.

FIG. 2 shows another embodiment of a winding apparatus in accordance with the invention, as may be used, for example, in a texturing machine. In the following description structural components of the same function are identified by the same numerals. A package holder 26 is mounted for rotation about the axis of the shaft 40 arranged in a machine frame. Two opposite centering plates 28 and 27 are rotatably supported at the free ends of the fork-shaped package holder 26. Between the centering plates 28 and 27, a tube 13 is clamped for receiving a package. A drive roll 29 lies against the circumference of tube 13. The drive roll 29 is mounted on a drive shaft 31. At one end, the drive shaft 31 is connected to a motor 30, which drives the drive roll 29 at a substantially constant speed. By frictional engagement, the tube 13 is driven by means of drive roll 29 at a winding speed which permits winding of the yarn at the yarn speed. The winding speed thus remains substantially constant during the winding cycle. Upstream of drive roll 29, a yarn traversing device 22 is arranged, which is of the so-called belt-type. In this traversing device, a traversing yarn guide 6 is attached to an endless belt 33. The belt 33 is guided parallel to tube 13 between two deflection pulleys 34.1 and 34.2. In the belt plane, a drive pulley 35 partially looped by the belt, is arranged parallel to the deflection pulleys 34.1 and 34.2. The drive pulley 35 is mounted to a drive shaft 44 of an electric motor 36. The electric motor 36 drives the drive pulley 35 oscillatingly, so that the traversing yarn guide 6 is reciprocated in the region between the deflection pulleys 34.1 and 34.2. The electric motor 36 is controllable via controller 8. The controller 8 is connected to a sensor 32 arranged on package holder 26. This sensor 32 senses a catching groove 21 of a yarn catching device 14 mounted on centering plate 27.

The sensor 32 of this embodiment is a pulse generator which releases per revolution a signal as a function of the catching groove 21. These pulses are converted in the controller for an evaluation of the position of the catching device and the rotational speed of tube 13. The tube 13 is clamped between the centering plates 27 and 28 such that the centering plates 27 and 28 rotate without slip at the rotational speed of the tube.

On the side opposite to the traversing device and drive roll 29, a suction device 37 is arranged. This suction device comprises a cutter 38 and a suction inlet opening 39.

Figure 3:
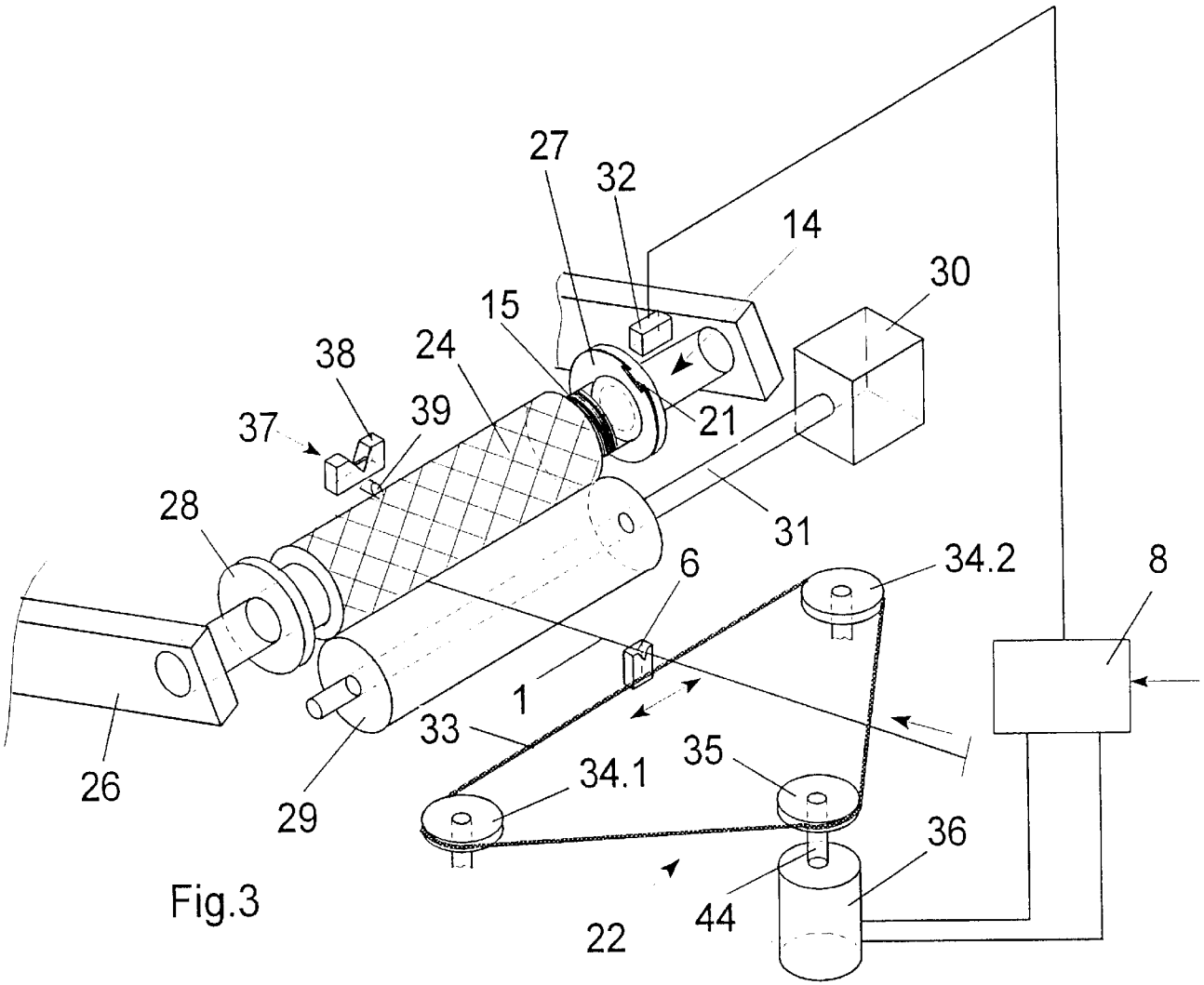
FIG. 3 illustrates the winding apparatus of FIG. 2 during winding.
Figure 4:
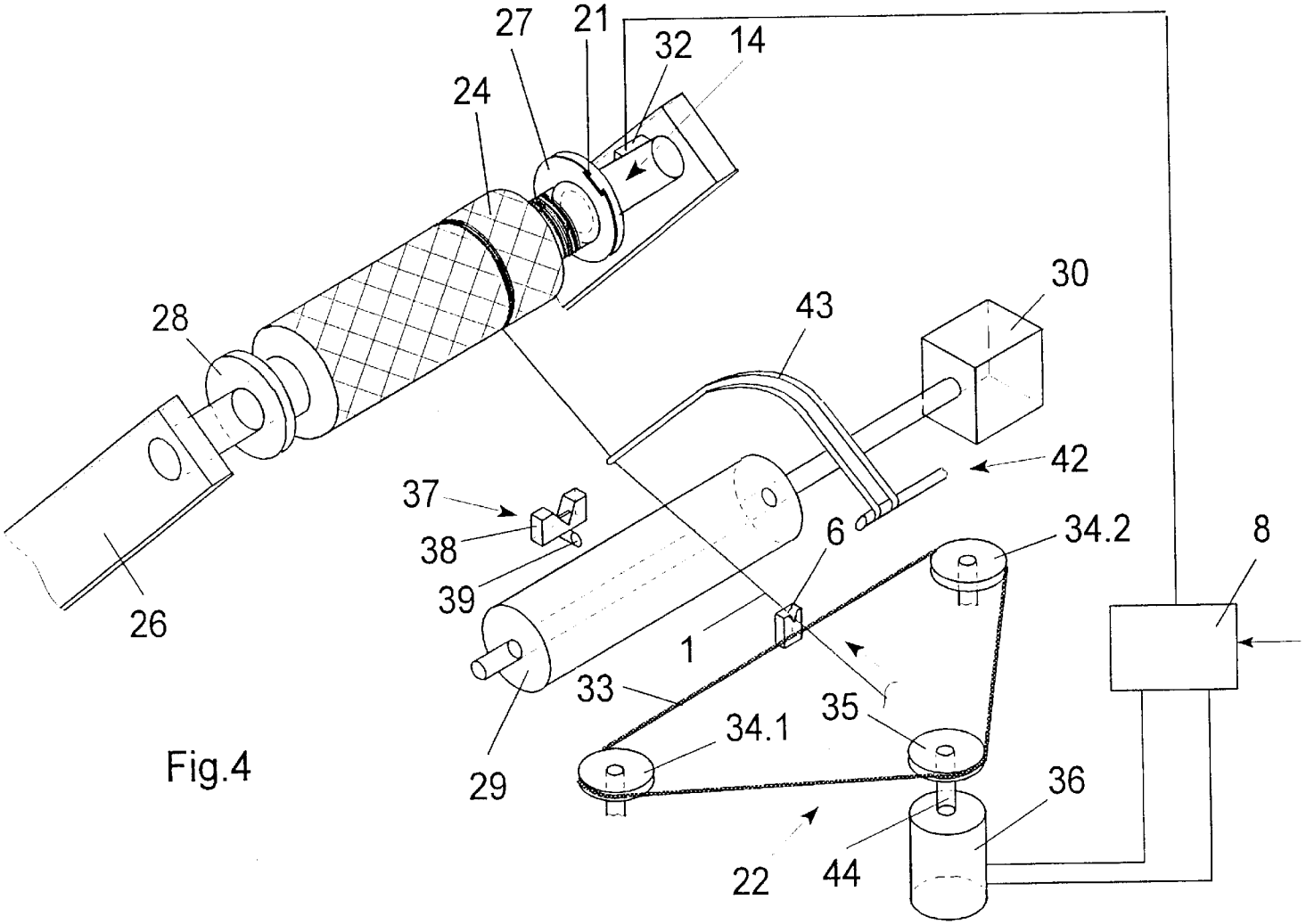
FIG. 4 illustrates the winding apparatus of FIG. 2 during a package doff.

FIGS. 2 to 4 show the winding apparatus of FIG. 2 in different operating situations. In FIG. 2, the continuously advancing yarn is guided by the suction device 37. To this end, the yarn is pulled into the suction inlet opening 39. Between the suction device 37 and an apex yarn guide (not shown), the yarn 1 is guided in traversing yarn guide 6, which may be guided in the direction toward the centering plate 27 to a doffing position. This doffing position may be selected such the yarn 1 is guided inside or outside the range of the tube. The tube 13 is driven by drive roll 30 in circumferential contact therewith to a winding speed that is predetermined by the drive roll. Each time the catching groove passes the sensor 32, the sensor generates a pulse which is supplied to the controller 8. The controller 8 has an evaluation unit which determines from the pulses entering per unit time the momentary rotational speed of the centering plate and, thus, of the tube. At the same time, each pulse indicates the position of the catching groove 21. After the tube 13 reaches the winding speed, and the catching groove is in a position necessary for a reliable catching, the controller 8 activates electric motor 36. The electric motor 36 moves the traversing yarn guide 6 from the doffing position to a catching position which is aligned with the catching device 14. The yarn 1 is caught in groove 21 and cut with a blade integrated in the catching device or centering plate 27. Such a centering plate is described, for example, in EP 0 403 949, which is herewith incorporated by reference.

The traversing yarn guide 6 is then guided from the catching position to the winding range. In this process, the initial layers of yarn 1 are wound on the tube 13 outside the winding range to form a yarn reserve wind. The formation of a yarn reserve wind may occur in that traversing yarn guide 6 remains in one position. In this instance, the yarn reserve wind has a number of parallel winds. However, the traversing yarn guide 6 may also be guided at a speed defined by motor 36 to the winding range, so that side-by-side winds are produced in the yarn reserve wind. As soon as the traversing yarn guide reaches the winding range, the winding cycle starts. The traversing yarn guide is then reciprocated by the traversing device 22 within the winding range. This situation is shown in FIG. 3. The increasing diameter of package 24 is accommodated by a pivotal movement of the package holder 26. To this extent, the package holder 26 is provided with biasing means (not shown), which generate on the one hand a contact pressure between the package 24 and the drive roll 29, which is necessary to drive the package, and which facilitate on the other hand a pivotal movement of the package holder 26.

FIG. 4 shows the winding apparatus at the end of a winding cycle. After the package 24 is fully wound, the traversing yarn guide 6 moves to a transfer position which is within the winding range, and it remains in this transfer position. A tie-off wind is thus produced on the package 24. At the same time, the package holder 26 with package 24 is pivoted out of its operating position. Simultaneously, a transfer device 42 starts to operate, in that a gripping arm 43 moves into the yarn path between the full package 24 and the traversing yarn guide 6. The gripping arm 43 is rotated from an idle position to a transfer position. In so doing, it engages the yarn 1 and guides same in the transfer position to the suction device 37. In the cutter 38, the yarn is then cut and taken over by the suction inlet opening 39. The loose yarn end is thereby deposited on the package in the region of the tie-off wind. The package 24 may now be replaced with an empty tube. In this connection, it is of advantage that the sensor 32 is mounted on the package holder and thus signals the standstill of the package by discontinuing the generation of pulses. The sensor signal may thus be used to activate a doffing device. After the package 24 is replaced with a tube, the sequence as previously described with reference to FIG. 1 restarts.

The method and apparatus of the present invention may be easily expanded to a winding apparatus which comprises a plurality of winding positions arranged serially one after the other. In this instance, each winding position may include a yarn guide for guiding the yarn outside the winding range. The yarn guides may be driven by means of one drive or even by individual drives.

Likewise, it is possible to construct the embodiment of FIG. 1 with a belt traversing device, as shown in FIG. 2, or with a traversing device that employs a cross-spiralled roll.

Furthermore, the winding spindle shown in FIG. 1 may also be driven by a drive roll.

Conversely, the winding apparatus shown in FIGS. 2–4 may also be equipped with a traversing device and a separate yarn guide for guiding the yarn outside the winding range. Advantageously, the yarn guide that guides the yarn for catching and winding the initial winds is moved in axial direction parallel to the tube. However, it is also possible to move yarn guide 18 by a pivotal movement into the yarn path. The traversing device may also be of the rotary blade type or the cross-spiralled roll type.

All of the above described embodiments of the winding apparatus may be used for carrying out the method, and they are characterized in particular by a time-optimized doffing phase. The invention permits the amount of waste that is produced during the doffing phase to be reduced to a minimum.

That which is claimed is:

1. A method of winding a continuously advancing yarn to form a yarn package, comprising the steps of mounting a bobbin tube at a winding position for rotation about the axis of the tube, guiding the advancing yarn into engagement with a yarn guide and then into a suction receptacle, accelerating the rotation of the bobbin tube to a predetermined winding speed, sensing the rotational speed of the bobbin tube, moving the yarn guide into a yarn catching position upon the rotational speed of the bobbin tube reaching the winding speed, and causing the yarn to be caught and wound into initial layers upon the yarn guide being moved to the yarn catching position.

2. The method as defined in claim 1 wherein the step of causing the yarn to be caught and wound into initial layers includes providing a yarn catching groove adjacent one end of the bobbin tube.

3. The method as defined in claim 2, comprising the further steps of sensing the position of the yarn catching groove and generating a signal in response thereto for initiating the movement of the yarn guide.

4. The method as defined in claim 1 wherein the yarn guide is moveable in opposite directions along a line which is parallel to the axis of the bobbin tube, and wherein the movement is controlled in each direction by a controllable drive at a variable speed.

5. The method as defined in claim 1 comprising the further subsequent steps of traversing the yarn axially along a winding range on the bobbin tube to form a cross wound package, and then guiding the advancing yarn to a transfer position within the winding range to form a tie-off wind on the package.

6. The method as defined in claim 5 wherein the step of traversing the yarn axially along a winding range includes maintaining the yarn in engagement with the yarn guide and traversing the yarn guide along a path aligned with the winding range, and wherein the step of guiding the advancing yarn to a transfer position includes moving the yarn guide into a position in alignment with the transfer position.

7. The method as defined in claim 5 comprising the further subsequent steps of moving the full package out of its position during the winding operation, and then directing the advancing yarn to a suction device where the yarn is cut and guided into the suction receptacle.

8. The method as defined in claim 1 wherein the predetermined winding speed is such as to generate a circumferential surface speed on the bobbin tube which is substantially the same as the speed of the advancing yarn.

9. An apparatus for winding a continuously advancing yarn to form a yarn package, comprising a bobbin tube mounting device for rotatably mounting a bobbin tube for rotation about its axis, a drive for rotating the bobbin tube so as to accelerate its rotation to a predetermined winding speed, a yarn catching device mounted on the bobbin tube or the mounting device so as to rotate with the tube, a yarn guide mounted for movement in a direction parallel to the axis of the mounting tube and between an initial position and a yarn catching position where the yarn guide is aligned with the yarn catching device, a drive for moving the yarn guide between the initial position and the yarn catching position, a sensor for monitoring the rotational speed of the bobbin tube, and a controller operatively connected to an output of the sensor for controlling the drive of the yarn guide so that the yarn guide is moved from the initial position to the yarn catching position upon the rotational speed of the tube reaching the predetermined winding speed.

10. The apparatus as defined in claim 9 wherein the yarn catching device comprises a catching groove and wherein the apparatus further comprises a sensor for sensing the position of the yarn catching groove.

11. The apparatus as defined in claim 10 wherein the sensor for monitoring the rotational speed of the bobbin tube and the sensor for sensing the position of the yarn catching groove comprise a common instrument.

12. The apparatus as defined in claim 9 wherein the bobbin tube mounting device comprises two opposing centering plates mounted on a package holder, wherein the yarn catching device is arranged on one of the centering plates, and wherein the rotational speed of the bobbin tube and the position of the catching groove are sensed by a common sensor.

13. The winding apparatus as defined in claim 12 wherein the common sensor is a pulse generator which signals to the controller by a pulse the position of the catching groove per revolution of the one centering plate, and wherein the controller has an evaluation unit which determines the rotational speed of the bobbin tube from the number of pulses per unit of time.

14. The apparatus as defined in claim 9 wherein the drive for moving the yarn guide is programmed to selectively reciprocate the yarn guide axially along a winding range on the bobbin tube to form a cross wound package.

15. The apparatus as defined in claim 14 wherein the drive for moving the yarn guide is programmed to move the yarn guide to a transfer position within the winding range upon the yarn packaging becoming full.

16. The winding apparatus as defined in claim 15 wherein the bobbin tube mounting device includes a holder which is pivotally mounted so as to be able to move the full package out of a winding position in which it was wound.

17. The winding apparatus as defined in claim 16 further comprising a suction device for cutting and receiving the advancing yarn, and a yarn transfer device for guiding the advancing yarn into the suction device upon the full package being pivoted outside the winding position, so as to cut the yarn and guide the same into the suction device.

18. The winding apparatus as defined in claim 17 wherein the transfer position of the yarn guide and the suction device are arranged in a common plane which is transverse to the axis of the bobbin tube.

19. The winding apparatus as defined in claim 18 wherein the yarn transfer device comprises a rotatable gripping arm that is rotatable between an idle position and a transfer position, and such that the gripping arm penetrates the yarn path during its pivotable movement so as to supply the yarn to the suction device.

20. The winding apparatus as defined in claim 19 wherein the suction device comprises a yarn cutter and a suction inlet opening.

21. The winding apparatus as defined in claim 16 wherein the sensor is mounted on the holder.

* * * * *

UNITED STATES PATENT AND TRADEMARK OFFICE
CERTIFICATE OF CORRECTION

PATENT NO. : 6,045,081

DATED : April 4, 2000

INVENTOR(S) : Oberstrass et al.

It is certified that error appears in the above-identified patent and that said Letters Patent is hereby corrected as shown below:

Title page, [56] References Cited, U.S. PATENT DOCUMENTS, insert the following:

| | | |
|---|---|---|
| --4,988,048 | 1/1991 | Lochbronner |
| 5,330,115 | 7/1994 | Mayer et al. |
| 5,511,734 | 4/1996 | Enger et al. |
| 5,158,241 | 10/1992 | Dammann et al.--. |

Title page, [56] References Cited, FOREIGN PATENT DOCUMENTS, insert the following:

| | | |
|---|---|---|
| --0 329 947 | 8/1989 | European Patent Office |
| 25 08 278 | 9/1976 | Germany |
| 41 15 339 | 11/1991 | Germany |
| 42 11 749 | 10/1993 | Germany |
| 44 24 468 | 1/1996 | Germany |
| 42 26 364 | 4/1993 | Germany |
| 0 403 949 | 12/1990 | European Patent Office--. |

UNITED STATES PATENT AND TRADEMARK OFFICE
CERTIFICATE OF CORRECTION

PATENT NO. : 6,045,081

DATED : April 4, 2000

INVENTOR(S) : Oberstrass et al.

It is certified that error appears in the above-identified patent and that said Letters Patent is hereby corrected as shown below:

Title page, [56] References Cited, insert the following:

--OTHER PUBLICATIONS

PATENT ABSTRACTS OF JAPAN, VOL. 013, NO. 223 (M-829), 24 MAY 1989, PUBLICATION JP 01 038379, TO SUMITOMO ELECTRIC IND LTD.--.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*